US005086853A

United States Patent [19]

Evans

[11] Patent Number: 5,086,853

[45] Date of Patent: Feb. 11, 1992

[54] LARGE BORE HYDRAULIC DRILLING JAR

[76] Inventor: Robert W. Evans, 12986 Wood Harbor, Montgomery, Tex. 77356

[21] Appl. No.: 670,249

[22] Filed: Mar. 15, 1991

[51] Int. Cl.[5] ..... E21B 31/113

[52] U.S. Cl. ..... 175/297; 166/178; 175/300

[58] Field of Search ..... 175/297, 296, 299, 300; 166/178

[56] References Cited

U.S. PATENT DOCUMENTS

| | | | |
|---|---|---|---|
| 4,109,736 | 8/1978 | Webb et al. | 175/297 |
| 4,186,807 | 2/1980 | Sutliff et al. | 175/300 X |
| 4,361,195 | 11/1982 | Evans | 175/297 |
| 4,566,546 | 1/1986 | Evans | 175/297 |
| 4,865,125 | 9/1989 | De Cuir | 166/178 |
| 5,007,479 | 4/1991 | Pleasants et al. | 166/178 |

*Primary Examiner*—Hoang C. Dang

*Attorney, Agent, or Firm*—Arnold, White & Durkee

[57] ABSTRACT

A double acting hydraulic drilling jar 1 includes a mandrel 2 arranged in a housing 3 for sliding longitudinal movement. A hammer 69 is positioned on the mandrel 2 and interacts with anvil surfaces 64, 66 in the housing 3 to deliver both upward and downward jarring forces to a drill string. A hydraulic valve arrangement permits the storage of large amounts of static force before releasing the hammer 69 to strike the anvil surfaces with great force. The hydraulic valve arrangement includes a tripping valve 95 positioned to be actuated by a first pair of engaging surfaces in response to downward movement of the mandrel 2 in the housing 3 and a second pair of engaging surfaces in response to upward movement of the mandrel 2 in the housing 3. Thus, independent control over the upward and downward jarring action is achieved.

9 Claims, 5 Drawing Sheets

LARGE BORE HYDRAULIC DRILLING JAR

BACKGROUND OF THE INVENTION

1. Technical Field

This invention relates generally to double acting hydraulic jars for use in drilling equipment and, in particular, to an improved mechanism for actuating the double acting hydraulic jar that is compact in size so as to increase the diameter of a drilling fluid bore extending through the jar and to increase the allowable overpull during actuation.

2. Description of the Related Art

Drilling jars have long been known in the field of well drilling equipment. A drilling jar is a tool employed when either drilling or production equipment has become stuck to such a degree that it cannot be readily dislodged from the wellbore. The drilling jar is normally placed in the pipe string in the region of the stuck object and allows an operator at the surface to deliver a series of impact blows to the drill string via a manipulation of the drill string. Hopefully, these impact blows to the drill string dislodged the stuck object and permit continued operation.

Drilling jars contain a sliding joint which allows relative axial movement between an inner mandrel and an outer housing without allowing rotational movement. The mandrel typically has a hammer formed thereon, while the housing includes an anvil positioned adjacent the mandrel hammer. Thus, by sliding the hammer and anvil together at high velocity, they transmit a very substantial impact to the stuck drill string, which is often sufficient to jar the drill string free.

Often, the drilling jar is employed as a part of the bottom hole assembly during the normal course of drilling. That is, the drilling jar is not added to the drill string once the tool has become stuck, but is used as a part of the string throughout the normal course of drilling the well. Thus, in the event that the tool becomes stuck in the wellbore, the drilling jar is present and ready for use to dislodge the tool.

However, since the drilling jar forms a portion of the drill string, then it must also include provision for passing drilling fluid therethrough. For example, drilling fluid is ordinarily circulated through an inner bore extending longitudinally through the drill string, out through the drill bit, and then up through the annulus formed by the wellbore and drill string. The drilling fluid is used to cool the drill bit, remove cuttings, and prevent "blowouts." A large volume of this drilling fluid is, therefore, passed through the longitudinal bore within the drill string. Clearly, with a larger diameter bore, more drilling fluid can be passed therethrough and the cooling and cutting removal is more efficiently performed. A drilling jar, however, differs substantially in mechanical complexity from the remainder of the drill string. This mechanical complexity necessarily results in a reduced diameter bore through the drilling jar, which, in turn, limits the flow of drilling fluid to the drill bit.

For example, U.S. Pat. No. 4,361,195, issued Nov. 30, 1982 to Robert W. Evans, describes a double acting drilling jar that has a reduced diameter longitudinal bore. In particular, the '195 patent describes an annular tripping valve that cooperates with a pair of control arms to provide this "double action." This mechanism, however, consumes a substantial diametric segment of the drilling jar, reducing the diameter of its internal longitudinal bore.

Further, the control arms of the '195 patent interact with the same control surfaces of the tripping valve to control both downward and upward jarring action. Accordingly, the same degree of movement between the mandrel and housing, and thus the same time delay, is present for actuating both upward and downward jarring. In some applications it is advantageous to have a different time delay associated with upward jarring than with downward jarring. The apparatus of the '195 patent has no such provision.

The present invention is directed to overcoming or minimizing one or more of the problems discussed above.

SUMMARY OF THE INVENTION

In one aspect of the present invention, a hydraulic tripping valve is provided for use in a double acting drilling jar consisting of a tubular mandrel arranged for telescoping movement within a tubular housing. A first flange is coupled to an interior surface of said tubular housing and extends a preselected distance therein to form first and second actuating surfaces on opposed surfaces of said first flange. A first annular valve member is positioned diametrically between the mandrel and housing of said drilling jar and is longitudinally displaced from said first flange. The first annular valve member has a second flange extending a preselected radial distance therefrom toward said housing in overlapping relation with said first actuating surface on said first flange. The first annular valve member has a diametrically interior surface having a recess formed therein to expose a third actuating surface. A second annular valve member is positioned diametrically between the mandrel and housing of said drilling jar and longitudinally adjacent and in sealing relationship with said first annular valve member. The second annular valve member has a third flange extending a preselected radial distance therefrom toward said housing in overlapping relation with said second actuating surface on said first flange. The second annular valve member has a diametrically interior surface having a recess formed therein to expose a fourth actuating surface. The first and second annular valve member recesses are formed adjacent and open to one another. Finally, an actuating mechanism is coupled to and movable with said mandrel. The actuating mechanism is positioned diametrically interior to said tripping valve and has a fourth flange extending a preselected distance therefrom into said first and second annular valve member recesses to form fifth and sixth actuating surfaces on opposed surfaces of said fourth flange. The fifth and sixth actuating surfaces are positioned in diametrically overlapping relation with said third and fourth actuating surfaces of said first and second annular members.

BRIEF DESCRIPTION OF THE DRAWINGS

Other objects and advantages of the invention will become apparent upon reading the following detailed description and upon reference to the drawings in which.

Figure 1A:
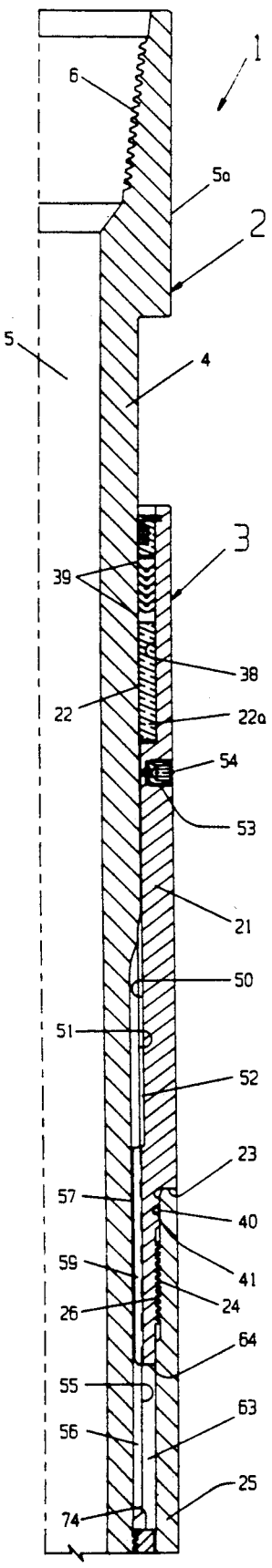
FIGS. 1A-1C illustrate successive portions, in quarter section, of a double acting hydraulic drilling jar located in its neutral operating position.

While the invention is susceptible to various modifications and alternative forms, specific embodiments thereof have been shown by way of example in the drawings and will herein be described in detail. It should be understood, however, that this specification is not intended to limit the invention to the particular forms disclosed herein, but on the contrary, the intention is to cover all modifications, equivalents, and alternatives falling within the spirit and scope of the invention, as defined by the appended claims.

DESCRIPTION OF A PREFERRED EMBODIMENT

Figure 1B:
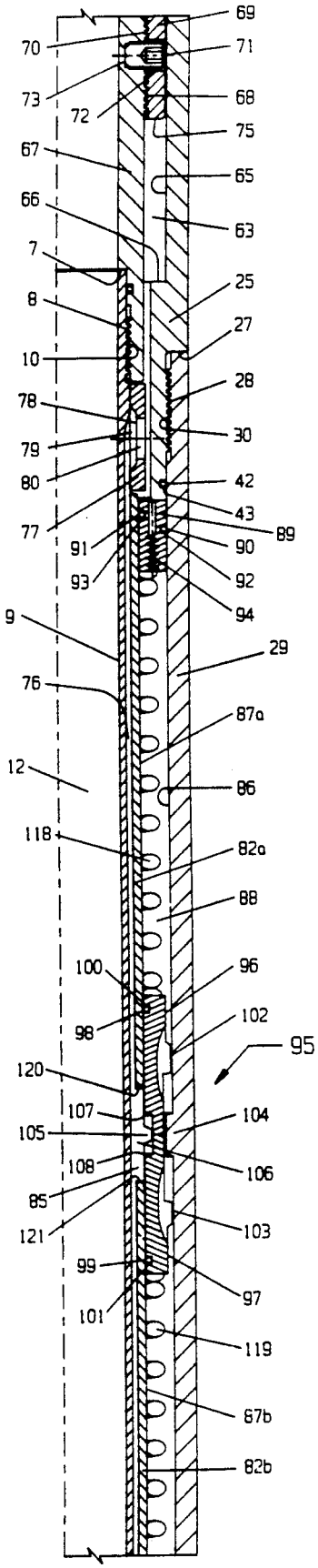
Figure 1C:
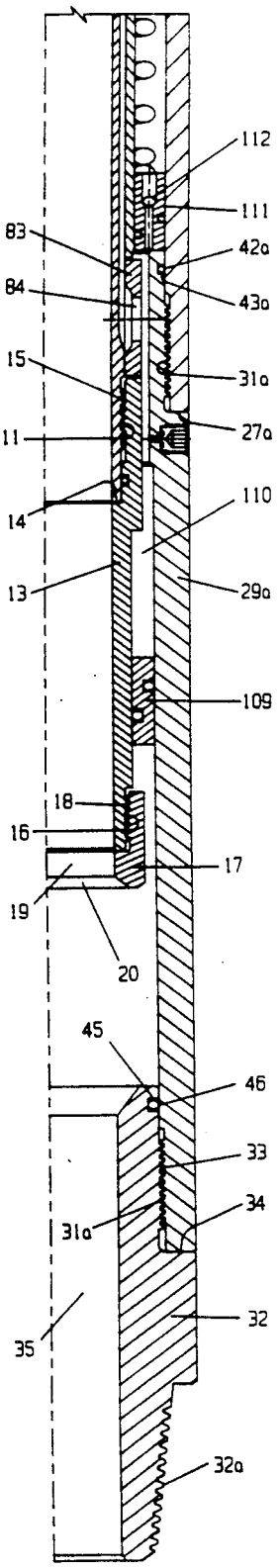

Referring to the drawings, and in particular, to FIGS. 1A-1C, inclusive, there is shown a double acting hydraulic mechanism or drilling jar 1 which is of substantial length necessitating that it be shown in three longitudinally broken quarter sectional views, viz. FIGS. 1A, 1B, and 1C. Each of these views is shown in longitudinal section extending from the center line (represented by a dashed line) of the jar 1 to the outer periphery thereof. The drilling jar 1 generally comprises an inner tubular mandrel 2 telescopingly supported inside an outer tubular housing 3. The mandrel 2 and housing 3 each consists of a plurality of tubular segments joined together preferably by threaded interconnections.

The mandrel 2 consists of an upper tubular portion 4 having an inner longitudinal passage 5 extending therethrough. The upper end of the upper tubular portion 4 is enlarged as indicated at 5a and is internally threaded at 6 for connection to a conventional drill string or the like (not shown). The lower end of the upper tubular portion 4 is provided with a counterbore ending in an internal shoulder 7 and is internally threaded as indicated at 8. An intermediate portion of the mandrel 2 consists of a tubular portion 9 which has its upper end threaded as indicated at 10 for connection inside the threaded portion 8 of the upper tubular portion 4 with the upper end portion abutting the shoulder 7. The lower end of the tubular portion 9 is threaded externally as indicated at 11 and is provided with an internal bore or passage 12, which is a continuation of the passage 5 in the upper tubular portion 4. The lower end of the mandrel 2 consists of a tubular portion 13, which is provided with a counterbore ending in a shoulder 14 and internally threaded as indicated at 15. The tubular portion 13 is threadedly assembled to the lower end of the tubular portion 9, with the lower end thereof abutting the shoulder 14.

The lower end portion of the tubular portion 13 is threaded as indicated at 16. A sleeve member 17 having internal threads 18 is threadedly secured on the lower end of the tubular portion 13. The tubular portion 13 is provided with an internal longitudinal passage 19 which is an extension of the passages 5, 12 and opens through a central opening 20 of the sleeve member 17. The three portions 4, 9, 13 of the mandrel 2, are threadedly assembled, as shown, into the unitary tubular mandrel 2 which is longitudinally movable inside the tubular housing 3.

The tubular housing 3 is formed in several sections for purposes of assembly, somewhat similar to the mandrel 2. The upper end of the tubular housing 3 consists of a tubular member 21 which has a smooth inner bore 22 formed by a conventional bearing 22a at its upper end in which the exterior surface of the upper mandrel tubular portion 4 is positioned for longitudinal, sliding movement. The lower end portion of the tubular housing member 21 has a portion of reduced diameter forming an annular shoulder 23 and having an exterior threaded portion 24.

The tubular housing 3 is provided with an intermediate tubular member 25 which is internally threaded as indicated at 26 at its upper end for threaded connection to the threaded portion 24 of the tubular member 21. The upper end of the intermediate tubular member 25 abuts the shoulder 23 when the threaded connection is securely tightened. The lower end portion of the tubular member 25 has a portion of reduced diameter forming a shoulder 27 and externally threaded, as indicated at 28.

The lower portion of the tubular housing 3 consists of a tubular member 29 which is internally threaded, as indicated at 30, at its upper end for connection to the threaded portion 28 of the intermediate tubular member 25. The upper end of the lower tubular member 29 abuts the shoulder 27 when the threaded connection is securely tightened. The lower end of the tubular member 29 is internally threaded, as indicated at 31.

A tubular member 29a is threadedly connected at its upper end to the threaded portion 31 of the tubular member 29 in abutting relation with the shoulder 27a. The lower end of the tubular member 29a includes a threaded portion 31a engageable with a tubular connecting member 32. The tubular connecting member 32 is externally threaded, as indicated at 33, at its upper end and has a shoulder 34 against which the lower end of the tubular member 29a abuts when the threaded connection 31a, 33 is securely tightened. The tubular connecting member 32 has an inner longitudinal passage 35 which is a continuation of the passages 5, 12, 19 through the mandrel 2. The lower end of the tubular connecting member 32 is of a reduced diameter and is provided with an externally threaded surface 32a for connection into the lower portion of a drill string or for connection to a fish, or the like (not shown), when the apparatus is used as a fishing jar.

As has already been noted, the mandrel 2 and housing 3 are formed in sections for purposes of assembly. The mandrel 2 is arranged for sliding movement inside housing 3. The drilling jar 1 is filled with a suitable operating fluid, e.g. hydraulic fluid, and it is therefore necessary to provide seals against leakage from threaded joints formed at the various sections of the mandrel 2 and housing 3 and also from the points of sliding engagement between the mandrel 2 and housing 3.

As previously noted, the exterior surface of the upper mandrel portion 4 has a sliding fit in the bore 22 of the upper tubular member 21 of the housing 3. The tubular member 21 is provided with at least one internal annular recess 38 in which there is positioned at least one seal 39, which seals the sliding joint against leakage of hydraulic fluid. Likewise, the threaded connection between the tubular housing members 21, 25 is sealed against leakage by an O-ring 40, or the like, positioned in an external peripheral groove 41 in the lower end of the tubular housing member 21. The threaded connection between the tubular housing members 25, 29 is similarly sealed against fluid leakage by an O-ring 42 positioned in a peripheral groove 43 in the lower end portion of the tubular housing member 25. Likewise, the threaded connection between the tubular housing members 29, 29*a* is sealed against fluid leakage by an O-ring 42*a* positioned in a peripheral groove 43*a* in the lower end portion of the tubular housing member 29*a*.

Finally, the threaded connection between the lower end of the tubular housing member 29*a* and the tubular connecting member sub 32 is similarly sealed against leakage of fluid by an O-ring 46 positioned in an peripheral groove 45 in the upper end of the tubular connecting member sub 32. Similar seals are provided to prevent leakage through the threaded joints connecting the several sections of the mandrel 2.

The space between the inner bore of the various components of the housing 3 and the external surface of the mandrel 2 provides an enclosed chamber and passages for the flow of hydraulic fluid (or other suitable operating fluid) throughout the drilling jar 1.

At the upper end of the tubular housing member 21, the space between an inner bore 50 thereof and an external surface 51 of the mandrel tubular portion 4 provides a chamber 52. The upper end of the chamber 52 is provided with a threaded opening 53 in which a threaded plug member 54 is secured. The threaded opening 53 provides for the introduction of hydraulic fluid (or other suitable operating fluid).

The exterior surface of the tubular mandrel portion 4 is of slightly reduced diameter at a lower end portion 55 thereof, and is provided with a plurality of longitudinally extending grooves 56 forming splines therebetween. The lower end portion of the housing tubular member 21 is provided with an inner bore 57 having a plurality of longitudinally extending grooves 59 therein and circumferentially spaced to define a plurality of splines therebetween to interact with the splines and grooves 56 in the upper tubular mandrel portion 4. The grooves 56, 59 in the tubular housing member 21 and in the tubular mandrel portion 4 are of greater depth than the height of the opposed splines positioned in those grooves 56, 59. As a result, longitudinal passages are provided along the respective grooves 56, 59 in the mandrel portion 4 and the housing member 21. The passages formed by the clearance between the splines and grooves 56, 59 permit hydraulic fluid to flow between the chamber 52 and the lower portions of the drilling jar 1, as will be subsequently described.

Additionally, the arrangement of longitudinally extending splines and grooves 56, 59 in the tubular housing member 21 and on the tubular mandrel portion 4 provides a guide for longitudinal movement of the mandrel 2 in the housing 3 without permitting rotary movement therebetween.

The clearance between the tubular housing member 25 and the mandrel portions 4, 9 is such that there is provided a hydraulic chamber 63 of substantially enlarged size relative to the hydraulic chamber 52. Within this enlarged chamber 63 is located the jarring apparatus, and, in particular, the hammer and anvil. The lower end of the tubular housing member 21 provides an upper anvil surface 64 which is utilized when the drilling jar 1 is actuated in an upward direction. An inner surface 65 of the tubular housing member 25 constitutes a counterbore which produces an internal circumferential shoulder at the lower end of the hydraulic chamber 63 and functions as an anvil 66 when the drilling jar is actuated in a downward direction.

The lower end portion 67 of the tubular mandrel portion 4 has its external surface 55 threaded, as indicated at 68. A hollow cylindrical hammer 69, having internal threads 70, is threadedly secured on the threaded portion 68 of the tubular mandrel portion 4 and is provided with a threaded plug or set screw 71 which extends through an opening 72 into a threaded recess 73 in the tubular mandrel portion 4. The hollow cylindrical hammer 69 is, therefore, threadedly secured on the lower end portion of the tubular mandrel portion 4 and further secured by the set screw 71 against rotation during operation. An upper end portion 74 of the hammer 69 is engageable during an upward actuation with the anvil surface 64 on the housing member 21. A lower hammer surface 75 of the hammer member 69 is engageable with the anvil surface 66 during a downward actuation of the drilling jar 1.

The tubular mandrel portion 9 is provided with a plurality of longitudinally extending grooves 76. The grooves 76 provide flow passages for the flow of hydraulic fluid, as will be subsequently described. A spacer ring 77 is supported on the tubular mandrel portion 9 and has an internal surface 78 spaced from the exterior surface of the mandrel portion 9 to provide an annular flow passage 79.

The spacer ring 77 is provided with apertures 80 which open from the passage 79 into the hydraulic chamber 63. The lower end of the passage 79 also overlaps the upper end of the grooves or passages 76 to provide continuous fluid communication between the hydraulic chamber 63 and the grooves 76. The upper end of the spacer ring 77 abuts the lower end of the tubular mandrel portion 4. The lower end of the spacer ring 77 is, in turn, abutted by the upper end of a first tubular portion 82*a* which fits over the external surface of the mandrel portion 9 in which the grooves 76 are formed. The first tubular portion 82*a*, therefore, encloses the grooves 76 and defines a system of longitudinally extending passages. The lower end of a second tubular portion 82*b* abuts an annular spacer ring 83 which is provided with a plurality of apertures 84 opening into the ends of the grooves or passages 76. The lower end of the first tubular portion 82*a* and the lower end of the second tubular portion 82*b* are also provided with a plurality of apertures or openings 85 that are controlled by a tripping valve 95, which will be subsequently described in great detail.

An inner surface 86 of the housing member 29 and outer surfaces 87*a*, 87*b* of the tubular portions 82*a*, 82*b* are spaced apart to define a hydraulic chamber 88. Generally, the hydraulic chamber 88 resists relative movement of the mandrel 2 and housing 3. That is, relative movement of the mandrel 2 and housing 3 reduces the volume of the chamber 88, causing a significant increase in the internal pressure of the chamber 88, thereby producing a force to resist this relative movement. This resistance to relative movement allows a large buildup of static energy. Thus, by quickly venting the chamber 88 to dramatically reduce the pressure therein, the static energy is converted to kinetic energy, causing the hammer 69 to move rapidly and strike one of the anvil surfaces 64, 66 with great force.

Accordingly, means is provided for substantially sealing the chamber 88 to permit the buildup of pressure therein. The surfaces 86, 87*a*, 87*b* of the chamber 88 are smooth cylindrical surfaces permitting free movement of a pair of pressure pistons supported therebetween and defining the chamber 88. At the upper end of the hydraulic chamber 88, there is provided an annular pressure piston 89 positioned between the surfaces 86, 87*a*for sliding movement therebetween. The piston 89 is sealed against fluid leakage by O-rings 90, 91 positioned in annular grooves 92, 93, respectively. Movement of the piston 89 is caused by engagement with the mandrel 2 and, in particular, a shoulder formed by the end of the spacer ring 77.

It should be appreciated that if the chamber 88 were perfectly sealed against the loss of hydraulic fluid, then little or no movement between the mandrel 2 and housing 3 would occur during pressurization of the chamber 88. Some movement, however, is preferred as a means to initiate the venting process. Accordingly, the piston 89 is provided with at least one passage 94 to permit a small leakage flow of hydraulic fluid therethrough. Alternatively, leakage flow can be provided by a loose fit of the piston 89 within the chamber 88, or the need for leakage flow can be eliminated by use of a compressible hydraulic fluid. In any event, the leakage flow causes slow deliberate movement of the mandrel 2 into the housing 3. This movement, as described more fully below, is used to actuate the tripping valve 95 and quickly vent the chamber 88.

The lower end of the chamber 88 is similarly sealed by an annular pressure piston 111, which is substantially similar to the piston 89. However, since the piston 89 is configured to provide sufficient leakage flow, then the piston 111 is sealed against outward flow from the chamber 88 by a conventional one-way check valve 112. Also, the piston 111 is moveable upwards by engagement with the annular spacer ring 83 during movement of the mandrel 2 upward and out of the housing 3.

The tripping valve 95 is positioned at approximately the center point of the chamber 88 and is urged to remain in this central position by a pair of coil springs 118, 119. The coil springs 118, 119 are positioned within the chamber 88 and respectively extend between the pressure pistons 89, 111 and the tripping valve 95. Thus, in addition to centralizing the tripping valve 95, the springs 118, 119 also operate to urge the pistons 89, 111 toward the ends of the chamber 88 and to urge the tripping valve 95 toward its closed position.

The tripping valve 95 is formed from a pair of separately moveable valve members 96, 97, which, when closed, isolate the chamber 88 from the hydraulic passage 76. The valve member 96 has an annular configuration which slidably engages the outer surface 87*a* of the first tubular portion 82*a*. The valve member 97 is of a substantially similar configuration and, likewise, slidably engages the outer surface 87*b* of the second tubular portion 82*b*. To prevent leakage between the sliding surfaces of the valve members 96, 97 and the tubular portions 82*a*, 82*b*, a pair of O-rings 98, 99 are positioned within annular grooves 100, 101 of the valve members 96, 97 respectively.

Each of the valve members 96, 97 has a flange 102, 103 formed thereon and extending radially outward toward the inner surface 86 of the tubular member 29. Preferably, the flanges 102, 103 engage the inner surface 86 in a sliding arrangement, but are not sealed therewith. Rather, the flanges 102, 103 occupy only a small circumferential portion of the chamber 88 and, therefore, form longitudinal grooves which permit the flow of hydraulic fluid therethrough. Preferably, a plurality of flanges 102, 103 are disposed in spaced relation about the circumference of the chamber 88.

The flanges 102, 103 are intended to engage and cooperate with a flange 104 extending radially inward from the tubular member 29. Preferably, the flange 104 extends about substantially the entire periphery of the tubular member 29 so that the flange 104 will engage the flanges 102, 103 independent of their circumferential position and prevent the valve members 96, 97 from passing thereby. That is, the outer diameter of the flanges 102, 103 is substantially greater than the inner diameter of the flange 104. Thus, longitudinal movement of the tripping valve 95 will cause engagement of one of the flanges 102, 103 with the flange 104, thereby urging the valve members 96, 97 to separate and hydraulically interconnect the chamber 88 with the passage 76.

However, it should be remembered that the tripping valve 95 is constructed for sliding movement on the tubular portion 82. Thus, movement of the mandrel 2 does not produce corresponding movement of the tripping valve 95. Rather, a flange 105 formed on an internal actuating mechanism 106 attached to the mandrel portion 9 is positioned to move with the tubular portion 82 and engage actuating surfaces 107, 108 located on the inner surfaces of the valve members 96, 97. Engagement of the flange 105 with the actuating surfaces 107, 108 causes the tripping valve to move longitudinally with the mandrel 2.

Figure 4:
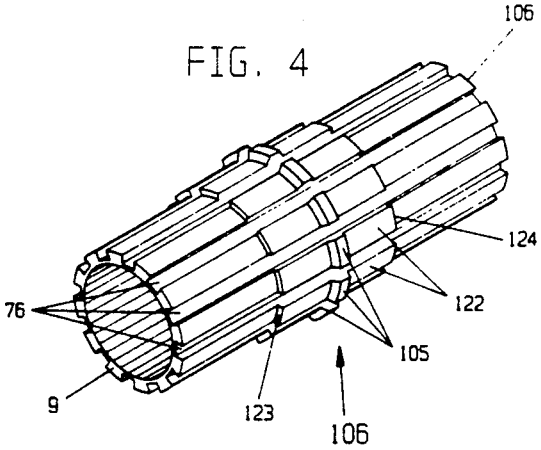
FIG. 4 illustrates a perspective view of an internal actuating mechanism of the tripping valve.

A better appreciation of the construction of the actuating mechanism 106 may be had by reference to FIG. 4 where a perspective view of a longitudinal section of the mandrel portion 9 is shown. The actuating mechanism 106 is constructed from a plurality of circumferentially raised portions 122 extending above the grooves 76 and forming first and second longitudinal shoulders 123, 124 that respectively engage the tubular portions 82*a*, 82*b* at shoulders 120, 121. Thus, it should be appreciated that the tubular portions 82*a*, 82*b* extend over the mandrel portion 9 and into engagement with the shoulders 123, 124, leaving the passages 76 open to the inner surfaces of the valve members 96, 97 and forming the passages 85.

The flanges 105 are formed at about the longitudinal midpoint of the actuating mechanism 106 on top of each of the raised portions 122. The flanges 105 extend a substantial radial distance above the outer surface of the raised portions 122. In particular, in the assembled configuration of FIG. 4, the outer diameter of the flange 105 is greater than the inner diameter of the tripping valve 95. Thus, longitudinal movement of the mandrel 2 and, consequently, the actuating mechanism 106 results in contact between the flange 105 and one of the actuating surfaces 107, 108.

Figure 2A:
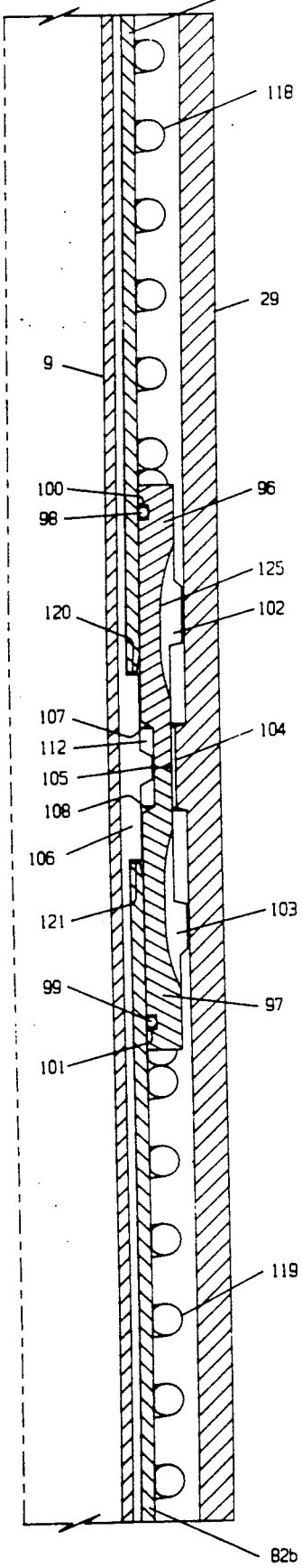
FIG. 2A illustrates a cross sectional quarter view of a tripping valve in its neutral position.
Figure 2B:
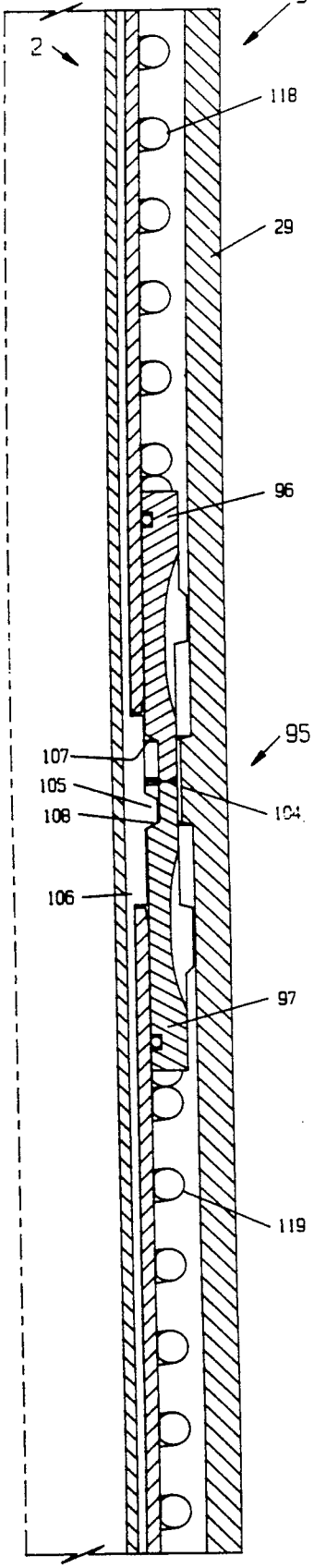
FIG. 2B illustrates a cross sectional quarter view of the tripping valve in a first partially actuated downward jarring position.
Figure 5:
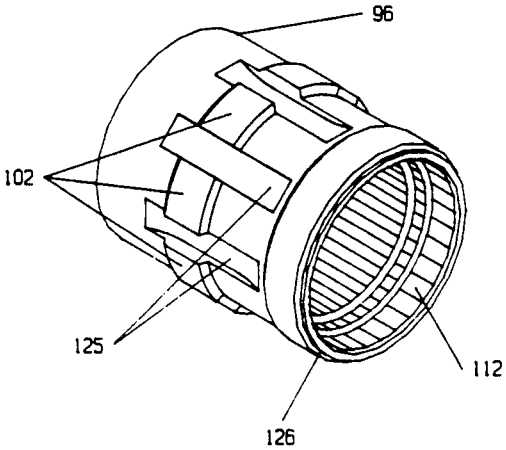
FIG. 5 illustrates a perspective view of an external actuating mechanism of the tripping valve.

A better appreciation of the construction of the tripping valve 95 may be had by reference to FIGS. 2A and 5, wherein an enlarged cross sectional and a perspective view of the valve member 96 are illustrated. The valve member 96 is generally cylindrical in configuration with the plurality of spaced apart flanges 102 extending radially outward therefrom. A plurality of longitudinal slots 125 are positioned between each of the flanges 10 to allow for the relatively free flow of hydraulic fluid past the flanges 102. A first end portion 126 of the valve member 96 has a sealing surface formed thereon for sealing engagement with the second valve member 97.

The valve member 97 has a plurality of guide fingers (not shown herein, but described in U.S. Pat. No. 4,361,195) that guide the movement of the valve member 96 during the opening and closing of the tripping valve 95. Preferably, the guide fingers extend longitudinally from the valve member 97 in circumferentially spaced apart locations. The guide fingers are positioned diametrically interior to the valve member 96. That is, a recess 112 is cut into the interior annular surface of the valve member 96. When the tripping valve 95 is closed, the recess 112 is occupied, at least partially by the guide fingers. The guide fingers are intended to ensure alignment of the valve member 96, 97 during closing so that their sealing surfaces are brought into substantial, aligned contact to hydraulically isolate the chamber 88 from the passages 76.

Referring again to FIG. 1C, a floating piston 109 is positioned in sealing relationship between the mandrel portion 13 and the tubular member 29*a* to isolate a hydraulically filled chamber 110 from the internal passage 35. The chamber 110 is hydraulically connected to the grooves 76 through the plurality of apertures 84. Thus, the chamber 110 is in hydraulic communication with the chambers 52, 63 to form a substantial fluid reservoir. The floating piston 109 moves longitudinally within the chamber 110 to accommodate pressure changes between the chambers 52, 63, 110 and the internal passage 35. These pressure changes are ordinarily associated with variations in the temperature of the operating environment.

A better appreciation of the operation of the tripping valve 95 may be had by reference to FIGS. 2A–2D, where enlarged cross sectional views of the tripping valve 95 in its various operating positions are shown. For example, FIG. 2A illustrates the tripping valve 95 located in its neutral or closed position. The interaction and movement of the various components of the drilling jar 1 may best be appreciated by a description of its operation during an actual downward and upward jarring actuation. Therefore, referring now to FIGS. 2B–2D, the movement of the various components of the drilling jar 1 during a downward jarring actuation is illustrated and discussed.

It should be appreciated that a significant operation occurring in the drilling jar 1 is the operation of the tripping valve 95. Accordingly, the operation of the tripping valve 95 is discussed in detail in conjunction with the series of drawings illustrated in FIGS. 2B through 2D. Further, a description of the tripping valve 95 in its neutral position has already been shown and discussed with respect to FIGS. 1B and 2A. Therefore, the following description of the operation of the tripping valve 95 during a downward jarring actuation begins in FIG. 2B where the mandrel 2 and, consequently, the actuating mechanism 106 are shown to have moved downward relative to the housing 3 and, in particular, to the tubular member 29.

The mandrel 2 has moved sufficiently far downward that the flange 105 on the actuating mechanism 106 has longitudinally moved through the recess 112 and contacted the actuating surface 108 of the valve member 97. At this point, neither of the valve members 96, 97 of the tripping valve 95 have been longitudinally displaced by movement of the mandrel 2. The coil springs 118, 119 have generally maintained the position of the tripping valve 95 at its central location in the chamber 88.

Figure 2C:
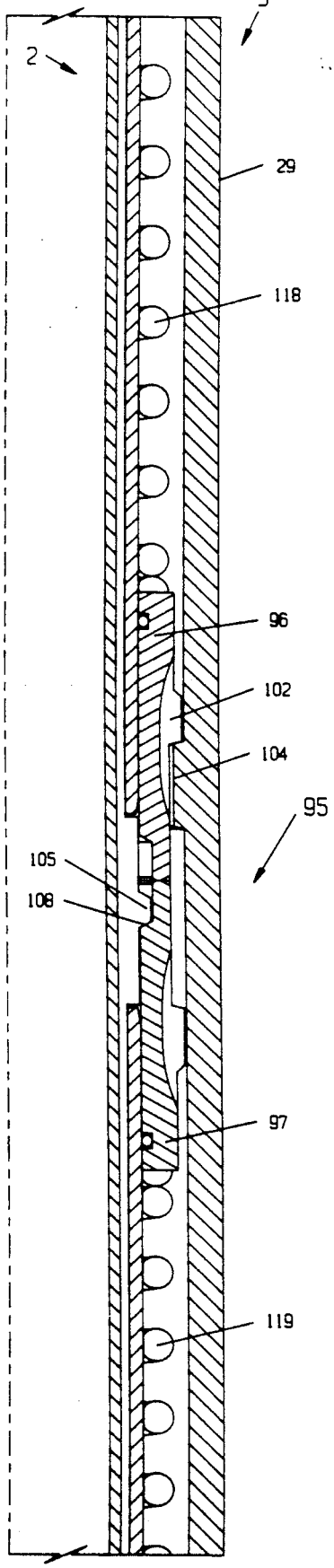
FIG. 2C illustrates a cross sectional quarter view of the tripping valve in a second partially actuated downward jarring position.

Turning now to FIG. 2C, the mandrel 2 and flange 105 are shown to have moved further downward, carrying with them the tripping valve 95. The valve members 96, 97 have not separated, owing to the force of the coil springs 118, 119 combined with the rising internal pressure of the of the chamber 88. It should be remembered, that the downward movement of the mandrel 2 carries the upper piston 89 with it, thereby reducing the volume of the chamber 88 and, consequently, increasing the pressure therein. The internal pressure of the chamber 88 acts against the outer surfaces of the valve members 96, 97 and urges them together to maintain their closed position.

In the position illustrated in FIG. 2C, the tripping valve 95 has been carried downward to a point where the flange 102 on the valve member 96 has just engaged the flange 104 of the housing 29.

Figure 2D:
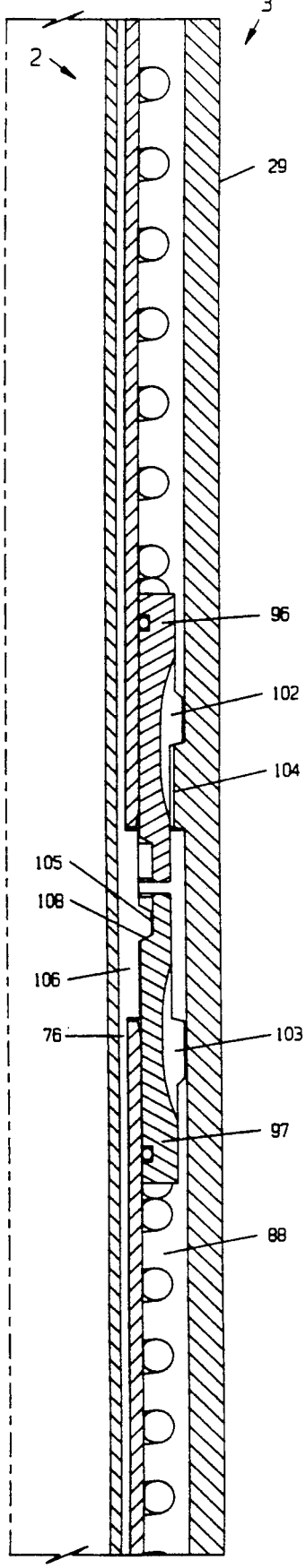
FIG. 2D illustrates a cross sectional quarter view of the tripping valve in a fully actuated downward jarring position.

Thus, turning now to FIG. 2D, continued downward movement of the mandrel 2 and the flange 105 of the actuating mechanism 106 forces the valve member 96, 97 into their separated or "open" position. The upper valve member 96 is restrained against further downward movement by the interaction of its flange 102 and the housing flange 104. However, further downward movement of the mandrel 2 forces the flange 105 against the actuating surface 108 of the lower valve member 97, causing it to separate from the upper valve member 96.

Figure 3A:
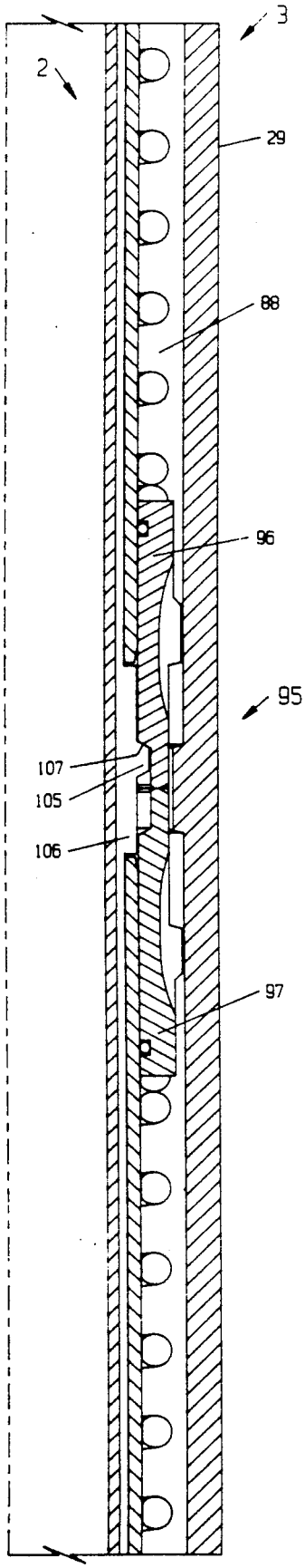
FIG. 3A illustrates a cross sectional quarter view of the tripping valve in a first partially actuated upward jarring position.
Figure 3B:
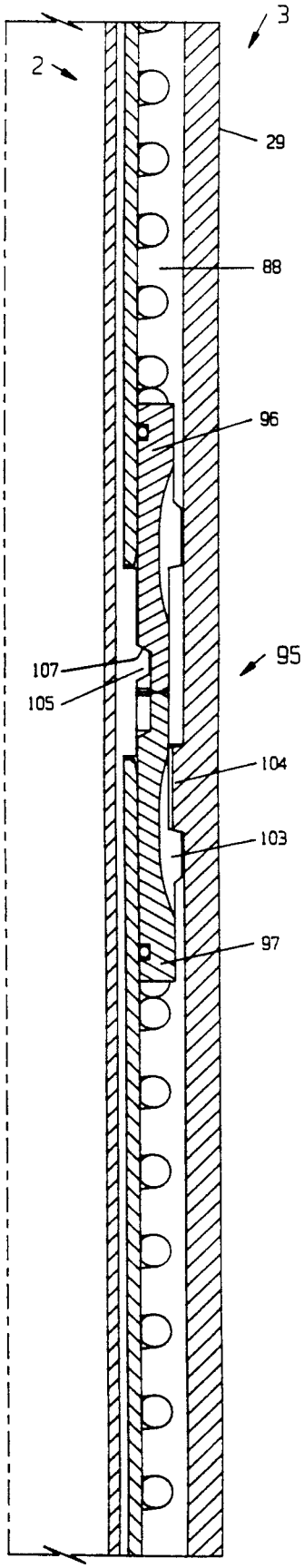
FIG. 3B illustrates a cross sectional quarter view of the tripping valve in a second partially actuated upward jarring position.
Figure 3C:
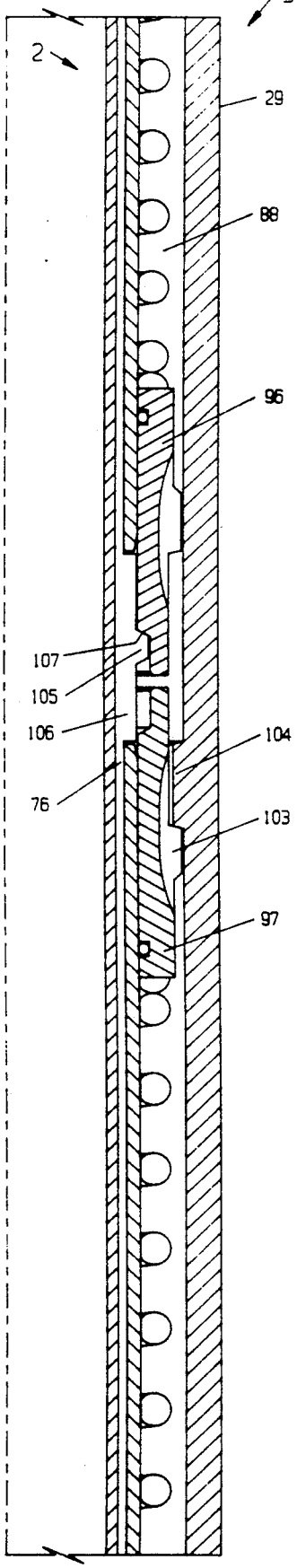
FIG. 3C illustrates a cross sectional quarter view of the tripping valve in a fully actuated upward jarring position.

Thus, with the relatively high pressure chamber 88 opened to the passages 76, hydraulic fluid quickly flows out of the chamber 88 and reduces the pressure therein. With the pressure in the chamber 88 substantially reduced, downward movement of the mandrel relative to the housing 3 is no longer resisted by a substantial force. Thus, the mandrel 2 now moves rapidly downward into the housing 3 causing the hammer 69 to sharply strike the lower anvil surface 66. Referring now to FIGS. 3A–3C, an upward jarring actuation of the drilling jar 1 is described. Once again, the upward drilling actuation is proceeded by the drilling jar 1 being positioned in its neutral position, as shown in FIG. 2A. An upward jarring action begins by the mandrel 2 being withdrawn or pulled upward and out of the housing 3. Upward movement of the drilling jar 2 causes the annular ring 83 to engage the lower piston 111 and move the piston 111 upward with the mandrel 2.

Movement of the piston 111, of course, reduces the volume of the chamber 88 and begins to drastically increase the pressure therein. As discussed previously, a small amount of hydraulic fluid is allowed to leak from the chamber 88 through the upper pressure piston 89, thereby permitting continued gradual movement of the mandrel 2 upward and out of the housing 3.

As the mandrel 2 moves upward, the actuating mechanism 106 along with its flange 105 are also carried upward, resulting in the flange 105 contacting the actuating surface 107 of the valve member 96, as shown in FIG. 3A. At this point, the tripping valve 95 has not moved longitudinally within the chamber 88, but remains centered in the chamber 88 between the upper and lower pressure pistons 89, 111.

Further upward movement of the mandrel 2 relative to the housing 3 causes the actuating mechanism 106 to continue moving upward therewith carrying the tripping valve 95 along with it. The tripping valve 95 continues to move upward through the chamber 88 with the mandrel 2 until it reaches the position shown in FIG. 3B, where the flange 103 on the valve member 97 contacts the flange 104 on the tubular member 29 of the housing 3.

At this point, the only flow of hydraulic fluid out of the chamber 88 has been through the upper pressure piston 89, and, thus, internal pressure of the chamber 88 is very high and substantially resists upward movement of the mandrel 2 relative to the housing 3. Accordingly, substantial potential energy has been stored in the drill string, which will be released by the venting action of the valve 95 in response to further upward movement of the mandrel 2 relative to the housing 3.

As shown in FIG. 3C, the flange 104 of the housing 3 acts against the flange 103 of the valve member 97 and captures the valve member 97 against further upward movement relative to the housing 3. Thus, continued upward movement of the mandrel 2 causes the flange 105 on the actuating mechanism 106 to act against the actuating surface 107 of the valve member 96 and force it upwards and away from the valve member 97. Thus, the chamber 88 is vented into the passages 76 and the pressure in the chamber 88 drops dramatically. With relatively low pressure in the chamber 88, further upward movement of the mandrel 2 is no longer resisted by a substantial force. Thus, the mandrel 2 moves rapidly upward causing the hammer 69 to sharply strike the upper anvil surface 64.

From the foregoing descriptions of the upward and downward jarring actuations, it should be apparent that none of the actuating surfaces of the various flanges 102, 103, 104, 105 are used in both the upward and downward jarring actuations. In other words, upward and downward jarring actuation is independent of one another. Therefore, by varying the longitudinal positions of the flanges 102, 103, 104, 105, varying time delays can be imposed on the upward and downward jarring actuations.

That is, in certain downhole environments it is desirable that the downward jarring actuation occur at a first preselected time, which is greater than the time delay for causing an upward jarring actuation. These differing time delays may be accommodated by relocating the longitudinal position of either the flange 105 or the flanges 102, 103, 104.

Alternatively, by changing the width of the various flanges 102-105, varying time delays may also be effected. For example, by increasing the width of the housing flange 104 above its longitudinal center line, the housing flange 104 contacts the valve member flange 102 after a first shortened time delay. However, since the width of the housing flange 104 below its longitudinal center line has not been changed, then the valve member flange 103 contacts the housing flange 104 after a second, unchanged time delay.

Finally, the configuration of the present tripping valve 95 allows a significant amount of overpull to be exerted on the drill string during the upward and downward drilling actuations. This large overpull advantageously produces significantly greater jarring force without exceeding the bursting pressure of the drilling jar 1. For example, the various components that form the chamber 88 are designed to accept a maximum internal pressure without damage thereto, such as bursting. This maximum pressure limits the force that can be applied to the drill string during the slow, deliberate movement of the mandrel 2 relative to the housing 3. That is, the force should not be so great as to produce a pressure within the chamber 88 that damages the sealing components.

However, since the external surfaces of the valve members 96, 97 are exposed to the high pressure within the chamber 88, they are held together by an additional force corresponding to the pressure times the surface area. Thus, when, for example, the drilling jar 1 reaches the configuration illustrated in FIG. 3C, the mandrel 2 will not simply continue to move and force the tripping valve 95 open, but rather, a force sufficient to overcome the hydraulic force holding the valve members 96, 97 together must be applied to force the tripping valve 95 open. Otherwise, if the force applied to the mandrel 2 is simply enough to just cause the mandrel 2 to move, then it will be insufficient to open the valve until enough fluid bleeds through the piston 89 to reduce the pressure within the chamber 88 to a level that the force applied to the mandrel 2 matches the force necessary to move the mandrel 2 plus the force required to overcome the hydraulic force holding the tripping valve 95 closed. Accordingly, significant overpull may be applied to the mandrel 2 without causing the sealing surfaces of the chamber 88 to fail.

Although a particular detailed embodiment of the apparatus has been described herein, it should be understood that the invention is not restricted to the details of the preferred embodiment, and many changes in design, configuration, and dimensions are possible without departing from the spirit and scope of the invention.

I claim:

1. A hydraulic tripping valve for use in a double acting drilling jar consisting of a tubular mandrel arranged for telescoping movement within a tubular housing, comprising:

a first flange coupled to an interior surface of said tubular housing and extending a preselected distance therein to form first and second actuating surfaces on opposed surfaces of said first flange;

a first annular valve member positioned diametrically between the mandrel and housing of said drilling jar and longitudinally displaced from said first flange, said first annular valve member having a second flange extending a preselected radial distance therefrom toward said housing in overlapping relation with said first actuating surface on said first flange, said first annular valve member having a diametrically interior surface having a recess formed therein to expose a third actuating surface;

a second annular valve member positioned diametrically between the mandrel and housing of said drilling jar and longitudinally adjacent and in sealing relationship with said first annular valve member, said second annular valve member having a third flange extending a preselected radial distance therefrom toward said housing in overlapping relation with said second actuating surface on said first flange, said second annular valve member having a diametrically interior surface having a recess formed therein to expose a fourth actuating surface, said first and second annular valve member recesses being formed adjacent and open to one another; and an actuating mechanism coupled to and movable with said mandrel, said actuating mechanism being positioned diametrically interior to said tripping valve and having a fourth flange extending a preselected distance therefrom into said first and second annular valve member recesses to form fifth and sixth actuating surfaces on opposed surfaces of said fourth flange, said fifth and sixth actuating surfaces being positioned in diametrically overlapping relation with said third and fourth actuating surfaces of said first and second annular members.

2. A hydraulic tripping valve, as set forth in claim 1, including a hydraulic chamber formed diametrically between said tubular mandrel and said tubular housing, said chamber being substantially sealed against unrestricted movement of hydraulic fluid therefrom by first and second pistons positioned at longitudinally opposite ends of said chamber, said pistons being configured for sliding movement within said chamber between said tubular mandrel and said tubular housing, and said tripping valve being positioned within said chamber and adapted for sealing said chamber against substantial loss of hydraulic fluid when configured in a closed position and for venting said chamber to a low pressure chamber in an open position.

3. A hydraulic tripping valve, as set forth in claim 2, wherein said first piston is adapted for engagement and movement with said tubular mandrel in response to movement of said tubular mandrel longitudinally into said tubular housing, whereby the volume of said chamber is reduced in response to longitudinal movement of said tubular mandrel into said tubular housing, and said second piston is adapted for engagement and movement with said tubular mandrel in response to movement of said tubular mandrel longitudinally out of said tubular housing, whereby the volume of said chamber is reduced in response to longitudinal movement of said tubular mandrel out of said tubular housing.

4. A hydraulic tripping valve, as set forth in claim 3, including first and second coil springs positioned in said chamber and extending longitudinally between the first and second pistons and the first and second annular valve members respectively, whereby the first and second pistons are urged away from the longitudinal center of the chamber and said first and second annular valve members are urged toward their closed position.

5. A double acting hydraulic drilling jar, comprising:

a tubular housing;

a tubular mandrel arranged for telescoping movement within said tubular housing and having a first flange coupled to an interior surface of said tubular housing and extending a preselected distance therein to form first and second actuating surfaces on opposed surfaces of said first flange;

a tripping valve, comprising:

a first annular valve member positioned diametrically between the mandrel and housing of said drilling jar and longitudinally displaced from said first flange, said first annular valve member having a second flange extending a preselected radial distance therefrom toward said housing in overlapping relation with said first actuating surface on said first flange, said first annular valve member having a diametrically interior surface having a recess formed therein to expose a third actuating surface; and a second annular valve member positioned diametrically between the mandrel and housing of said drilling jar and longitudinally adjacent and in sealing relationship with said first annular valve member, said second annular valve member having a third flange extending a preselected radial distance therefrom toward said housing in overlapping relation with said second actuating surface on said first flange, said second annular valve member having a diametrically interior surface having a recess formed therein to expose a fourth actuating surface, said first and second annular valve member recesses being formed adjacent and open to one another; and an actuating mechanism coupled to and movable with said mandrel, said actuating mechanism being positioned diametrically interior to said tripping valve and having a fourth flange extending a preselected distance therefrom into said first and second annular valve member recesses to form fifth and sixth actuating surfaces on opposed surfaces of said fourth flange, said fifth and sixth actuating surfaces being positioned in diametrically overlapping relation with said third and fourth actuating surfaces of said first and second annular members.

6. A double acting hydraulic drilling jar, as set forth in claim 5, including a hydraulic chamber formed diametrically between said tubular mandrel and said tubular housing, said chamber being substantially sealed against unrestricted movement of hydraulic fluid therefrom by first and second pistons positioned at longitudinally opposite ends of said chamber, said pistons being configured for sliding movement within said chamber between said tubular mandrel an said tubular housing, and said tripping valve being positioned within said chamber and adapted for sealing said chamber against substantial loss of hydraulic fluid when configured in a closed position and for venting said chamber to a low pressure chamber in an open position.

7. A hydraulic tripping valve, as set forth in claim 6, wherein said first piston is adapted for engagement and movement with said tubular mandrel in response to movement of said tubular mandrel longitudinally into said tubular housing, whereby the volume of said chamber is reduced in response to longitudinal movement of said tubular mandrel into said tubular housing, and said second piston is adapted for engagement and movement with said tubular mandrel in response to movement of said tubular mandrel longitudinally out of said tubular housing, whereby the volume of said chamber is reduced in response to longitudinal movement of said tubular mandrel out of said tubular housing.

8. A double acting hydraulic drilling jar, as set forth in claim 7 including first and second coil springs positioned in said chamber and extending longitudinally between the first and second pistons and the first and second annular valve members respectively, whereby the first and second pistons are urged away from the longitudinal center of the chamber and said first and second annular valve members are urged toward their closed position.

9. A double acting hydraulic drilling jar, comprising:

a tubular housing;

a tubular mandrel arranged for telescoping movement within said tubular housing and having a first flange coupled to an interior surface of said tubular housing and extending a preselected distance therein to form first and second actuating surfaces on opposed surfaces of said first flange;

a tripping valve, comprising:

a first annular valve member positioned diametrically between the mandrel and housing of said drilling jar and longitudinally displaced from said first flange, said first annular valve member having a second flange extending a preselected radial distance therefrom toward said housing in overlapping relation with said first actuating surface on said first flange, said first annular valve member having a diametrically interior surface having a recess formed therein to expose a third actuating surface; and a second annular valve member positioned diametrically between the mandrel and housing of said drilling jar and longitudinally adjacent and in sealing relationship with said first annular valve member, said second annular valve member having a third flange extending a preselected radial distance therefrom toward said housing in overlapping relation with said second actuating surface on said first flange, said second annular valve member having a diametrically interior surface having a recess formed therein to expose a fourth actuating surface, said first and second annular valve member recesses being formed adjacent and open to one another;

an actuating mechanism coupled to and movable with said mandrel, said actuating mechanism being positioned diametrically interior to aid tripping valve and having a fourth flange extending a preselected distance therefrom into said first and second annular valve member recesses to form fifth and sixth actuating surfaces on opposed surfaces of said fourth flange, said fifth and sixth actuating surfaces being positioned in diametrically overlapping relation with said third and fourth actuating surfaces of said first and second annular members;

first and second pistons positioned between said tubular mandrel and said tubular housing at longitudinally spaced apart locations to form a hydraulic chamber, said chamber being substantially sealed against unrestricted movement of hydraulic fluid therefrom by said pistons, said pistons being configured for sliding movement within said chamber between said tubular mandrel and said tubular housing, and said tripping valve being positioned within said chamber and adapted for sealing said chamber against substantial loss of hydraulic fluid when configured in a closed position and for venting said chamber to a low pressure chamber in an open position, said first piston being adapted for engagement and movement with said tubular mandrel in response to movement of said tubular mandrel longitudinally into said tubular housing, whereby the volume of said chamber is reduced in response to longitudinal movement of said tubular mandrel into said tubular housing, and said second piston being adapted for engagement and movement with said tubular mandrel in response to movement of said tubular mandrel longitudinally out of said tubular housing, whereby the volume of said chamber is reduced in response to longitudinal movement of said tubular mandrel out of said tubular housing; and first and second coil springs positioned in said chamber and extending longitudinally between the first and second pistons and the first and second annular valve members respectively, whereby the first and second pistons are urged away from the longitudinal center of the chamber and said first and second annular valve members are urged toward their closed position.

* * * * *

UNITED STATES PATENT AND TRADEMARK OFFICE
CERTIFICATE OF CORRECTION

PATENT NO. : 5,086,853

DATED : February 11, 1992

INVENTOR(S) : Evans

It is certified that error appears in the above-identified patent and that said Letters Patent is hereby corrected as shown below:

Column 10, line 13, please delete the second "of the".

Column 10, line 40, after "mandrel", please insert --2--.

Column 14, line 32, please delete "an" and insert --and--.

Signed and Sealed this

Twenty-second Day of June, 1993

*Attest:*

Michael K. Kirk

MICHAEL K. KIRK

*Attesting Officer*

*Acting Commissioner of Patents and Trademarks*